US011448240B2

(12) United States Patent
Williams et al.

(10) Patent No.: US 11,448,240 B2
(45) Date of Patent: Sep. 20, 2022

(54) USING A LOAD SENSE PUMP AS A BACKUP FOR A PRESSURE-COMPENSATED PUMP

(71) Applicant: Halliburton Energy Services, Inc., Houston, TX (US)

(72) Inventors: Drew Dustin Williams, Duncan, OK (US); Chad Adam Fisher, Ache, OK (US); Wesley John Warren, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 107 days.

(21) Appl. No.: 17/043,188

(22) PCT Filed: Jul. 11, 2018

(86) PCT No.: PCT/US2018/041585
§ 371 (c)(1),
(2) Date: Sep. 29, 2020

(87) PCT Pub. No.: WO2020/013816
PCT Pub. Date: Jan. 16, 2020

(65) Prior Publication Data

US 2021/0054835 A1 Feb. 25, 2021

(51) Int. Cl.

| | |
|---|---|
| ***F15B 11/17*** | (2006.01) |
| ***F15B 20/00*** | (2006.01) |
| ***F04B 23/04*** | (2006.01) |
| ***F04B 49/06*** | (2006.01) |

(Continued)

(52) U.S. Cl.
CPC ..... *F15B 11/17* (2013.01); *F04B 23/04* (2013.01); *F04B 49/007* (2013.01);
(Continued)

(58) Field of Classification Search
CPC .... F15B 11/17; F15B 20/004; F15B 2211/895
(Continued)

(56) References Cited

U.S. PATENT DOCUMENTS 4,704,865 A * 11/1987 Archung ..... B64C 13/42 60/428
4,711,089 A * 12/1987 Archung ..... B64C 13/42 60/405

(Continued)

FOREIGN PATENT DOCUMENTS

| | | |
|---|---|---|
| WO | 2016060972 | 4/2016 |
| WO | 2020013816 | 1/2020 |

OTHER PUBLICATIONS

International Application No. PCT/US2018/041585, International Search Report and Written Opinion, dated Apr. 9, 2019, 10 pages.

(Continued)

*Primary Examiner* — Michael Leslie
(74) *Attorney, Agent, or Firm* — Kilpatrick Townsend & Stockton LLP

(57) ABSTRACT

A load sense pump can be used as a backup for a pressure-compensated pump in a wellbore operation. A pumping system can include a first pump, a second pump, a check valve, and a directional control valve. The first pump, which can be a load sense pump, can be used to provide pressure to a first hydraulic load. The second pump, which can be a pressure-compensated pump, can be used to provide pressure to a second hydraulic load. The directional control valve can be controllable to cause the first pump to change operation to provide pressure to the first hydraulic load and through the check valve to the second hydraulic load.

17 Claims, 5 Drawing Sheets

(51) Int. Cl.
*F04B 49/00* (2006.01)
*F04B 49/03* (2006.01)

(52) U.S. Cl.
CPC ..... *F04B 49/065* (2013.01); *F15B 20/004* (2013.01); *F04B 49/03* (2013.01); *F04B 2205/05* (2013.01); *F04B 2205/09* (2013.01); *F15B 2211/8752* (2013.01)

(58) Field of Classification Search
USPC ..... 60/405, 428–430
See application file for complete search history.

(56) References Cited

U.S. PATENT DOCUMENTS 5,540,050 A 7/1996 Krupowicz
6,901,754 B2 * 6/2005 Jervis ..... F15B 11/17 60/468
8,190,342 B2 5/2012 Shinohara
8,347,618 B2 1/2013 Dostal et al.
8,434,301 B2 5/2013 Fukui
9,284,719 B2 * 3/2016 Lim ..... E02F 9/2292
2005/0072145 A1 4/2005 Jervis
2014/0290768 A1 10/2014 Randle et al.
2015/0273419 A1 10/2015 Chong
2021/0054835 A1 2/2021 Williams et al.

OTHER PUBLICATIONS

CA Application No. CA3,097,337 , Office Action, dated Nov. 17, 2021, 3 pages.

* cited by examiner

USING A LOAD SENSE PUMP AS A BACKUP FOR A PRESSURE-COMPENSATED PUMP

TECHNICAL FIELD

The present disclosure relates generally to devices for use in hydraulic fluid pumping environments. More specifically, but not by way of limitation, this disclosure relates to using a load sense pump as a backup for a pressure-compensated pump in a wellbore operation.

BACKGROUND

A fracturing environment can include a fracturing blender assembly to supply fluid and additives to various pressure-related fracturing operations. An example of pressure-related fracturing operations is flushing a wellbore to prevent proppant from settling and plugging off the wellbore. A fracturing blender assembly can include pressure-compensated hydraulic pumps to provide constant high fluid pressure in order to operate the components in a hydraulic circuit for purposes of flushing a wellbore. The pressure-compensated hydraulic pumps can provide adequate pressure despite the actual load so that the produced pressures stay above a threshold operating level. The pressure-compensated hydraulic pumps, however, can fail, causing cessation of operations within the fracturing environment, possible damage to the pressure-compensated pumps and wellbore equipment, and damage to the structural integrity of the wellbore. Inability to flush a wellbore due to the failure of a pressure-compensated pump can involve maintenance and repair. Maintaining constant high pressure to operate components in a hydraulic circuit for purposes of flushing a wellbore as needed is important to maintain peak operational efficiency and reduce operational costs.

DETAILED DESCRIPTION

Figure 1:
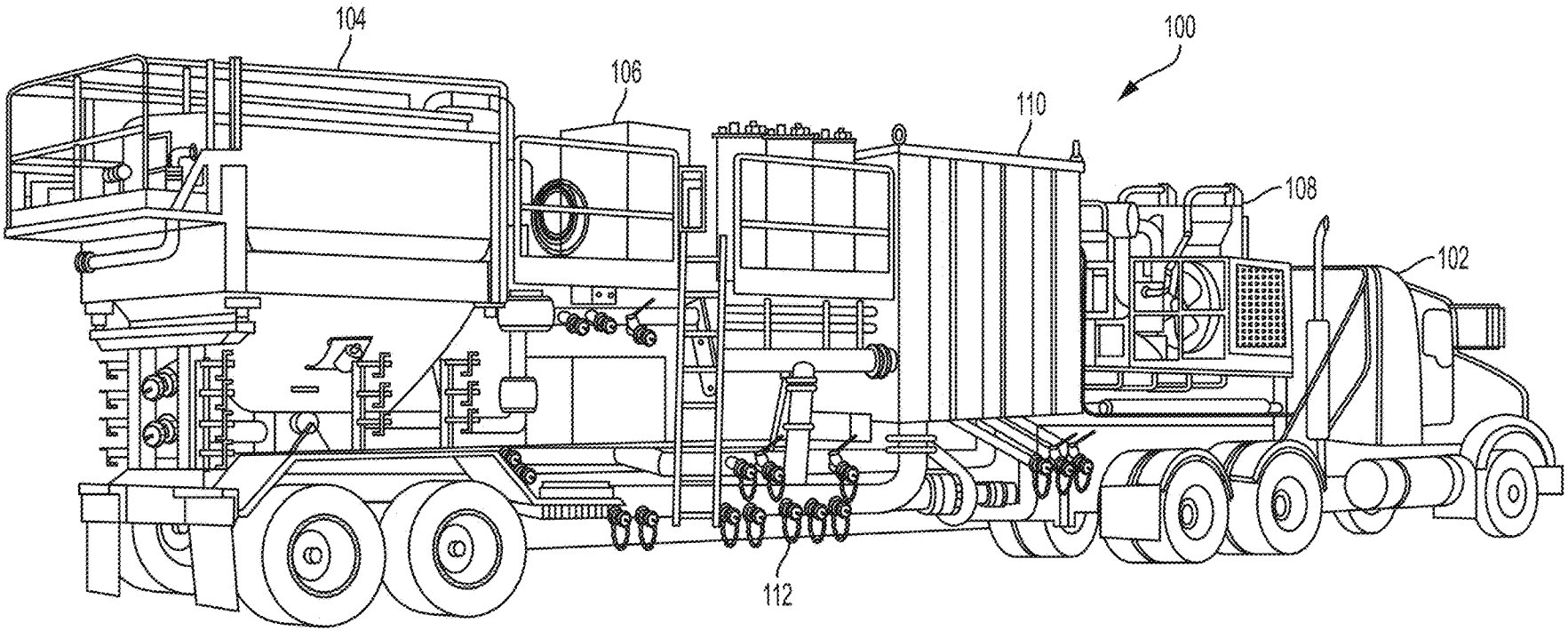
FIG. 1 is a perspective view of an example of a fracturing blender assembly that is a truck that includes a load sense pump for use as a backup for a pressure-compensated pump according to one aspect of the disclosure.

Certain aspects and features of the present disclosure relate to using a load sense hydraulic pump as a backup for a pressure-compensated hydraulic pump in a fracturing blender environment. During normal operation, the load sense pump and the pressure-compensated pump can operate independently and provide hydraulic fluid flow within separate hydraulic circuits. Examples of equipment operated by the hydraulic pumps include rotary actuators for opening and closing process fluid valves, liquid additive pumps, dry additive feeders, and other equipment requiring hydraulic pressure. The load sense pump can increase its typically low discharge pressure to the higher pressure setting of the pressure-compensated pump and communicate hydraulic fluid to the loads of the pressure-compensated pump in the event of a failure of the pressure-compensated pump. A pressure-compensated pump failure is indicated by the pump not maintaining its desired pressure set point. Sensors and other circuitry can be used to determine when pressure supplied by the pressure-compensated pump falls below a hydraulic pressure threshold value. In response to detecting a pressure-compensated pump failure, the outlet of the load sense pump can be connected to the pressure-compensated loads and the outlet pressure from the load sense pump can be increased to the setting of the pressure-compensated pump so that functions performed by the loads continue, (e.g., the process fluid valves remain in the appropriate positions). By allowing the functions of the pressure-compensated loads to continue in the event of a pressure-compensated pump failure, wellbore operations do not need to be halted to perform remedial measures.

In some examples, the load sense pump, after being configured to support the pressure-compensated loads, can continue to operate the equipment connected to the load sense hydraulic circuit (e.g., the liquid additive pumps and dry additive feeders). By increasing the outlet pressure of the load sense pump, the load sense pump can supply adequate pressure to the pressure-compensated loads in the case of a pressure-compensated pump failure. The load sense pump can further support the pressure-compensated pump when the pressure-compensated pump is not supplying adequate pressure to the loads. For example, pressure supplied by a failing pressure-compensated pump can dip below a threshold pressure value, at which point the load sense pump can be toggled to supply pressure above the threshold pressure to the pressure-compensated line.

Pressure-compensated hydraulic pumps can provide a constant outlet pressure regardless of the equipment installed in the hydraulic circuit downstream of the pump. The pressure-compensated pump can supply high pressure (e.g., around 3000 psi) to components that require high pressure but low flowrates (e.g., actuators for opening and closing process fluid valves). Generally, the controls on load sense hydraulic pumps can adjust the outlet pressure of the load sense pumps to the largest pressure required by any of the connected loads plus a small additional pressure (e.g., 200 to 300 psi). The load sense pump can operate by maintaining only a small additional pressure drop across an orifice, which can be accomplished by a feedback or sense line connected to a pump control head. The load sense pump can stroke enough to maintain the small pressure differential by providing the flow necessary to operate the component. Typically, if a load sense pump were installed in a pressure-compensated circuit, the load sense pump may not be able to operate the circuit. Without feedback, the load sense pump may not begin to stroke to provide pressure and hydraulic fluid flow to operate the pressure-compensated components. A flow distribution manifold can include check valves and switching valves to use a load sense pump in a pressure-compensated circuit.

A load sense pump can supply lower pressure (e.g., less than 3000 psi) to components that require higher flowrates but lower pressure (e.g., liquid additive pumps and dry additive feeders). A load sense pump can support the pressure-compensated pump by providing additional hydraulic pressure when circuitry detects a need to increase flow and maintain the required pressure of the pressure-compensated pump circuit. To provide an increase in hydraulic pressure by the load sense pump, the output of the load sense pump can be connected to the pump control head. Feeding the output of the load sense pump to the pump control head during a pressure-compensated pump failure can cause the load sense pump to output increasing levels of hydraulic pressure. For example, the load sense pump may not reach the pressure differential set point and continue to ramp up pressure outputs. In an attempt to reach the desired pressure differential, the load sense pump can remain at full stroke. Operating the load sense pump at full stroke may cause damage to the pump, so safety measures such as overrides or mechanical limitations can be implemented to prevent over pressurization of the system.

In oil field pumping, drilling, and fracturing environments, operations can be run continuously without stoppage. Equipment reliability can be of great importance in terms of overall production and cost reduction. Pressure-compensated pumps can be used for supplying hydraulic pressure to pressure-operated equipment essential for flushing wellbores. For example, a pressure-compensated circuit on a fracturing blender must remain functional to be able to open and close process valves. Process valve control can be necessary to ensure the correct blending flow path is selected and maintained. Continuous use of pressure-compensated pumps can cause pump degradation and eventual failure, requiring other functions to be halted to repair or replace the damaged pressure-compensated pump. The outlet pressure of the pressure-compensated pump may fall below the desired threshold value, which is considered a pump failure, for many different reasons. For example, the failure may be due to malfunction of an engine or motor used to drive the pump, electronics used for control, or feedback or excessive kickback from pump loads. Failure of one in-line component used to drive a pressure-compensated pump can cause failure of the entire pumping system.

Utilizing an existing load sense pump configurable as a backup for a pressure-compensated pump can increase the reliability of a pressure-compensated hydraulic circuit in fracturing and blending environments. A load sense pump that can supply support pressure to the pressure-compensated hydraulic circuit can decrease cost, weight, and spatial requirements by eliminating the need for a dedicated secondary pressure-compensated pump. This can improve overall operating efficiency by reducing the risk of production stoppage to make repairs in the event of pressure-compensated pump failure while simultaneously reducing design cost and spatial requirements.

Although described in the context of a hydrocarbon extraction environment via a wellbore, devices and apparatus of the present disclosure can be used in other environments in which hydraulic power is used. For example, a load sense pump according to some aspects can be used as a backup for a pressure-compensated pump in construction applications.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts a perspective view of a fracturing blender assembly 100 including a load sense pump for use as a backup for a pressure-compensated pump according to one example. The fracturing blender assembly 100 can be portable, such that the components of the fracturing blender assembly 100 can be included on or constructed as an affixed portion of a trailer unit that may be towed by a truck 102. In other examples, the fracturing blender assembly 100 may be portable as being constructed as an affixed portion of a vehicle. For example, a fracturing blender assembly can be constructed as a permanent component of a truck producing a single fracturing blender assembly truck unit.

The fracturing blender assembly 100 can include a bulk material tank 104, a control station 106, a power source 108, a hydration tank 110, and fracturing pump outlet 112. In certain examples, the power source 108 can be an internal combustion engine that provides, entirely or in part, power for operating the components of a load-sense pump circuit, a pressure-compensated pump circuit, and the control station 106.

A load-sense pump circuit and a pressure-compensated pump circuit can be housed within the fracturing blender assembly 100 and can provide separate outlet pressures to operate various valves using hydraulic fluid. The load sense pump can use hydraulic fluid to apply pressure to valves for purposes of controlling load sense loads. The pressure-compensated pump can use hydraulic fluid to apply pressure to other valves for purposes of controlling pressure-compensated loads. The load sense loads and pressure-compensated loads can control process fluid sourced from the bulk material tank 104 through the hydration tank 110. The bulk material tank 104 can include fluid that can be directed to a process pump in the hydration tank 110. The fluid in the process pump can be used as process fluid that can be pressurized and controlled by the pressure-compensated loads and load sense loads, and then outputted at the fracturing pump outlet 112. The process fluid output from the fracturing pump outlet 112 can be used to flush a well.

The load-sense pump circuit and the pressure-compensated pump circuit can be isolated from each other when applying hydraulic fluid pressure to the valves that cause the loads to control the process fluid within the process pump. In the event of a pressure-compensated circuit failure, the load sense circuit can be connected to the pressure-compensated pump circuit to supply hydraulic fluid pressure to the pressure-compensated loads so that control and pressurization of the process fluid in the process pump continues.

The control station 106 may include a control panel and a computer that provides for control of the various functions performed within the fracturing blender assembly 100. The control station 106 may be operable by a fracturing engineer or other operator, configured for automated control, or a combination of manual and automated control. For example, the control station 106 may control the configurations of various pumps. The control station 106 may be operable to monitor or control other aspects of the fracturing blender assembly 100 including issuing override commands.

In other examples, the fracturing blender assembly 100 may be a stand-alone pumping system including, at a minimum, a load sense pump and a pressure-compensated pump in which the load sense pump can be used as a backup for the pressure-compensated pump in case of failure.

Figure 2:
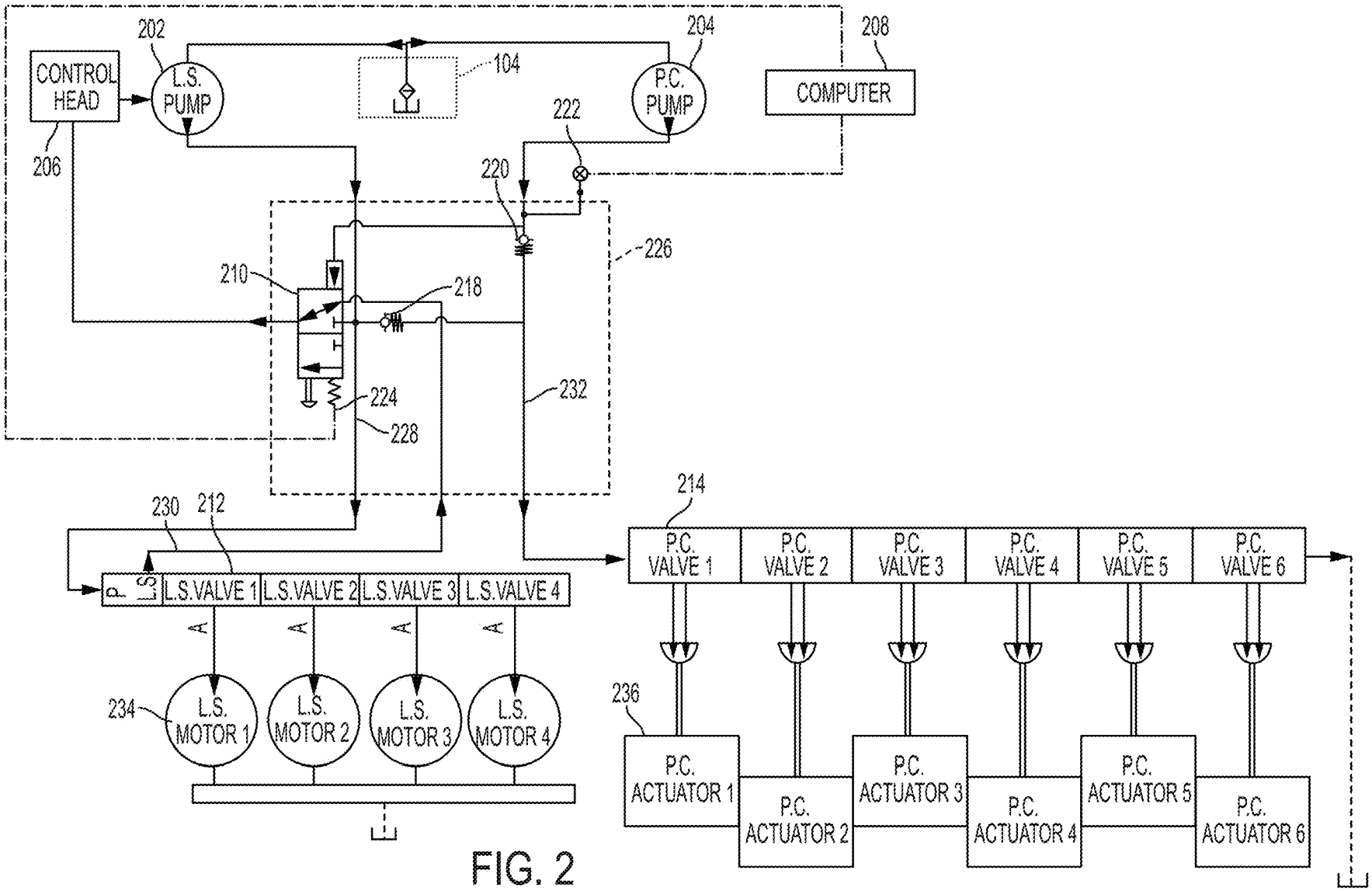
FIG. 2 is a schematic of a system for using a load sense pump as a backup for a pressure-compensated pump according to one aspect of the disclosure.

FIG. 2 is a schematic of a system for using a load sense pump 202 as a backup for a pressure-compensated pump 204 according to one example. A load sense pump 202 can be used to provide hydraulic pressure to a pressure-compensated load 236 when a pressure-compensated pump 204 fails. During normal operation, the load sense pump 202 and the pressure-compensated pump 204 can operate independently and provide hydraulic fluid flow within separate hydraulic circuits, which can be referred to as hydraulic systems. For example, the load sense pump 202 can provide hydraulic pressure to loads in a circuit, and the pressure-compensated pump 204 can provide hydraulic pressure to loads on a different circuit. In the event of a pressure-compensated pump 204 failure, the pump lines of the load sense pump 202 and the pump lines of the pressure-compensated pump 204 can be fluidly connected through their respective circuits so that the load sense pump 202 can deliver hydraulic fluid to the pressure-compensated load 236. A directional control valve 210 can be used to route the output of the load sense pump 202 to a control head 206 when the pressure-compensated pump 204 fails. The control head 206 can regulate the hydraulic pressure output of the load sense pump 202 such that the load sense pump 202 can try to reach an unobtainable pressure differential and continue to ramp up the pressure output. In some examples, the control head 206 can be part of the load sense pump 202. The output of the load sense pump 202 can increase to supply adequate hydraulic pressure to the pressure-compensated load 236.

The load sense pump 202 can operate in a non-pressure-compensated pump configuration when the pressure-compensated pump 204 is providing adequate pressure to the pressure-compensated load 236. When the load sense pump 202 is in a non-pressure-compensated configuration, the output of the load sense pump 202 can remain disconnected from the output line of the pressure-compensated pump, isolating the load sense circuit from the pressure-compensated circuit. The load sense pump 202 can be any conventional type of pump that is capable of sensing a pressure value being applied to a load. The load sense pump 202 can be powered by any conventional source of energy typically used in a wellbore operation such as an engine, electric motor, or other prime movers. In a non-pressure-compensated pump configuration, the load sense pump 202 can provide pressure to the load sense load 234. Hydraulic fluid can be provided to the load sense pump 202 for use in pressurizing the load sense load 234. The load sense pump 202 can supply, via a load sense pump-line 228, hydraulic fluid to a load sense valve 212. The hydraulic fluid supplied via the load sense pump 202 through the load sense valve 212 can be used to operate the load sense load 234.

In some examples, the load sense valve 212 can control the amount of hydraulic pressure being applied to the load sense load 234. The load sense valve 212 can have a load-sense feedback line 230. The load-sense feedback line 230 can communicate pressure applied at the load sense valve 212. The load-sense feedback line 230 can be connected to the directional control valve 210. When the load sense pump 202 is not used as a backup for the pressure-compensated pump 204, the directional control valve 210 can communicate the pressure level at the load sense valve 212 via the load-sense feedback line 230 to the control head 206. The control head 206 can direct the load sense pump 202 to increase or decrease pressure or remain at the current pressure level to adjust the pressure received by the load sense load 234 through the load sense valve 212. Adjusting the pressure via the control head 206 can allow the load sense pump 202 to provide enough pressure to the load sense load 234 without over-pressurizing the load sense circuit or consuming unnecessary energy. This closed-loop feedback configuration can allow the load sense pump 202 to supply the load sense load 234 with the precise amount of pressure to operate.

The load sense load 234 can be any conventional tool or device used to control process fluid in a fracturing environment, such as motors, actuators, and other pressure-operated equipment. The load sense pump-line 228 can be connected to multiple valves or a valve stack to which the load sense pump 202 can provide hydraulic fluid, each valve connecting to a different load. For example, the load sense pump-line 228 can be connected to a first valve and a second valve. The first valve can be connected to a first motor, and the second valve can be connected to a second motor, where the second motor requires a higher hydraulic pressure to operate than the first motor. The load sense pump 202 can supply the pressure to operate the first motor and the second motor simultaneously. For example, the first motor may require 200 psi to operate and the second motor may require 300 psi to operate. The load sense pump 202 can maintain the highest pressure requirement of the loads (e.g., 300 psi) plus a small pressure differential in order to operate both loads. The first valve and second valve, along with associated load line tube sizing can determine the amount of pressure that each load receives from the load sense pump-line 228.

The pressure-compensated pump 204 can operate independent of the load sense pump 202 when the pressure-compensated pump 204 supplies adequate hydraulic pressure to the pressure-compensated load 236. The pressure-compensated pump 204 can be powered by any conventional source of energy typically used in a wellbore operation such as an engine, electric motor, or other prime movers. Hydraulic fluid can be provided to the pressure-compensated pump 204 for use in pressurizing the pressure-compensated load 236. The pressure-compensated pump 204 can supply, via a pressure-compensated pump-line 232, hydraulic fluid to a pressure-compensated valve 214. The pressure-compensated valve 214 can control the amount of hydraulic pressure being applied to the pressure-compensated load 236. The hydraulic fluid supplied via the pressure-compensated pump 204 through the pressure-compensated valve 214 can be used to operate the pressure-compensated load 236.

The pressure-compensated load 236 can be any conventional tool or device used to control process fluid in a fracturing environment, such as motors, actuators, and other pressure-operated equipment. The pressure-compensated pump-line 232 can be connected to multiple valves or a valve stack to which the pressure-compensated pump 204 can provide hydraulic fluid, each valve connecting to a different load. For example, the pressure-compensated pump-line 232 can be connected to a first valve and a second valve. The first valve can be connected to a first actuator, and the second valve can be connected to a second actuator, where the second actuator requires a lower hydraulic pressure to operate than the first actuator. The pressure-compensated pump 204 can supply the pressure to operate the first actuator and the second actuator simultaneously. The first valve and second valve, along with associated load line tube sizing can determine the amount of pressure that each load receives from the pressure-compensated pump-line 232.

The load sense pump 202 can be configured as a backup for the pressure-compensated pump 204 using various components in a flow distribution manifold 226. The flow distribution manifold 226 can include the directional control valve 210, a check valve 218, and a check valve 220. The load sense pump 202 can be used as a backup for the pressure-compensated pump 204 when the pressure-compensated pump 204 fails to provide sufficient pressure to the pressure-compensated load 236. Failure of the pressure-compensated pump 204 may occur when the pressure-compensated pump 204 or any component in line with the pressure-compensated pump 204 prevents the pressure-compensated load 236 from receiving adequate hydraulic pressure to control process fluid in a process pump for purposes of flushing a well. For example, failure of an engine to power the pressure-compensated pump 204 can cause the pressure-compensated pump to choke or shut down, reducing the hydraulic pressure output required to operate the pressure-compensated load 236 below a threshold pressure value. Once the pressure supplied by the pressure-compensated pump 204 dips below the threshold pressure value, the load sense pump can supply hydraulic pressure to both the load sense load 234 and the pressure-compensated load 236. In some examples, the threshold pressure value at which the load sense pump 202 becomes a backup for the pressure-compensated pump 204 can be a preset threshold pressure value. The threshold pressure value can be predetermined by mechanical limitations and/or defined by software on a computer.

The load sense pump 202 can be configured as a backup for the pressure-compensated pump 204 when the system of FIG. 2 detects that the pressure output of the pressure-compensated pump 204 has fallen below a threshold pressure value. A pressure transducer 222 can be used to detect the level of pressure being produced by the pressure-compensated pump 204. The pressure transducer 222 can be communicatively coupled to a computer 208 to determine if the detected pressure level on the pressure-compensated pump 204 has fallen below a threshold pressure value. The computer 208 can be electrically connected to the directional control valve 210. In some examples, the directional control valve 210 can be a two-position three-way valve and can be electrically operated.

The computer 208 can be any computing device 116 that can include a processor, a bus, a communications port, and a memory. In some examples, the components of the computer 208, such as the processor, bus, communications port, and memory, can be integrated into a single structure. For example, the components can be within a single housing. In other examples, the components of the computer 208 can be distributed in separate housings and in electrical communication with each other.

The processor of the computer 208 can execute one or more operations for implementing some examples. The processor can execute instructions stored in the memory to perform the operations. The processor can include one processing device or multiple processing devices. Non-limiting examples of the processor include a Field-Programmable Gate Array ("FPGA"), an application-specific integrated circuit ("ASIC"), a microprocessor, etc.

The processor can be communicatively coupled to the memory via the bus. The non-volatile memory may include any type of memory device that retains stored information when powered off. Non-limiting examples of the memory include electrically erasable and programmable read-only memory ("EEPROM"), flash memory, or any other type of non-volatile memory. In some examples, at least some of the memory can include a medium from which the processor can read instructions. A computer-readable medium can include electronic, optical, magnetic, or other storage devices capable of providing the processor with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The computer 208 can send a signal to the directional control valve 210 through a communication medium 224. The signal provided by the computer 208 to the directional control valve 210 can switch the active connection to the control head 206 between the output of the load sense pump 202 and load-sense feedback line 230. The load sense pump 202 can operate independent of the pressure-compensated pump 204 to provide precise pressure to the load sense load 234 when the load-sense feedback line 230 is connected to the control head 206. The load sense pump 202 can operate as a pressure-compensated pump backup to provide pressure to both the load sense load 234 and pressure-compensated load 236 when the output of the load sense pump 202 is connected to the control head 206. The control head 206 can be connected to the output of the load sense pump 202 through the load sense pump-line 228.

Normally, a load sense pump can operate to provide the precise amount of hydraulic pressure to a load by measuring the pressure value after being applied to the load. This can allow the load sense pump to adjust the pressure output based on the feedback received by the control head from the load. The load sense pump can constantly seek to maintain a pressure differential between the output of the load sense pump and the pressure value measured at the load. The load sense pump can maintain a steady flow of hydraulic pressure when the pressure differential measured by the control head is achieved. When the pressure differential between the output of the load sense pump and the pressure measured at the load is not at a correct set point, the load sense pump can increase or decrease pressure output to realign to the correct pressure differential value. A pressure differential lower than the set point can cause the load sense pump to increase pressure output, and a pressure differential higher than the set point can cause the load sense pump to decrease pressure output.

For example, if a load requires 300 psi ("pounds per square inch") to operate, and the load sense pump 202 can output 600 psi to meet the 300 psi load requirement, the load sense pump 202 can attempt to maintain a pressure differential slightly above 300 psi (e.g., the pressure differential set point is 300 psi). If the load becomes overworked and requires 500 psi to operate, the load sense pump can ramp up the hydraulic pressure output to 800 psi to maintain the 300 psi pressure differential. If the load becomes underworked and requires 100 psi to operate, the load sense pump 202 can ramp down the hydraulic pressure output to 400 psi to maintain the 300 psi pressure differential.

When the pressure transducer 222 detects that the hydraulic pressure output of the pressure-compensated pump 204 has dropped below a threshold value, the computer 208 can toggle the directional control valve 210. Toggling the directional control valve 210 can switch the control head 206 input from the load-sense feedback line 230 to the output of the load sense pump 202. Connecting the output of the load sense pump 202, instead of the load-sense feedback line 230, to the control head 206 can disrupt the pressure differential measurement. This can cause the load sense pump 202 to seek to maintain a pressure differential against the same output value. The load sense pump 202 can never achieve the pressure differential when the control head 206 is directly connected to the output of the load sense pump 202.

For example, if the load sense pump 202 sought to maintain a pressure differential of 300 psi, and the output of the load sense pump 202 was then outputting 200 psi, the control head 206 may measure 200 psi. The pressure differential may be near zero, and the load sense pump 202 may increase the psi from 200 in an attempt to reach the pressure differential set point. However, as the load sense pump 202 increases the pressure in an attempt to reach 500 psi to obtain a pressure differential of 300 psi, the control head may measure the new increasing output values, and instruct the load sense pump to output higher pressure values continuously. As a result, the load sense pump 202 can continue to ramp up the hydraulic pressure to the maximum set point. The maximum set point of the load sense pump 202 can supply enough pressure to the load sense load 234, via the load sense pump-line 228, and the pressure-compensated load 236, via the pressure-compensated pump-line 232. To satisfy the pressure requirements of the pressure-compensated load 236, the load sense pump 202 can produce hydraulic pressure in a pressure-compensated pump configuration that can be greater than the needs of the load sense load 234. The load sense valve 212, load sense load 234, and other various loads pressurized by the load sense pump 202 can be designed to withstand the increase in pressure. In some embodiments, pipe sizing may be designed specifically to address the increase in pressure applied to the load sense valve 212 and the load sense load 234 when using the load sense pump 202 as a backup for the pressure-compensated pump 204.

When the pressure transducer 222 detects that the hydraulic pressure output of the pressure-compensated pump 204 is equal to or greater than the threshold pressure value, the computer 208 can toggle the directional control valve 210 to switch the control head 206 input from the output of the load sense pump 202 to the load-sense feedback line. For example, the load-sense feedback line 230 can be connected from the control head 206 and the output of the load sense pump 202 can be disconnected to the control head 206. Switching the connection to the control head 206 from the output of the load sense pump 202 back to the load-sense feedback line 230 can configure the load sense pump 202 into a load sense configuration. In a load sense configuration, the load sense circuit can operate independent of the pressure-compensated circuit and may no longer supply pressure to the pressure-compensated load 236. The ability to switch the load sense pump 202 between a load sense configuration and a pressure-compensated configuration can allow the system to maintain the required pressure on the pressure-compensated load 236 at all times. This allows the system shown in FIG. 2 to flush a well despite failure of the pressure-compensated pump 204, therefore reducing production time and cost otherwise spent performing additional remedial measures.

In some examples, the computer 208 and corresponding memory can include instructions to prevent the directional control valve 210 from toggling the input to the control head 206 ineffectively. Ineffective toggling can include switching the load sense pump 202 to and from the pressure-compensated configuration repeatedly within a short period. For example, the pressure output measured by the pressure transducer 222 can be equal to or close to the threshold pressure value. The pressure output can fluctuate above and below the threshold pressure value rapidly in small increments, causing the computer to toggle the directional control valve 210 in response to each fluctuation. For example, the pressure-compensated circuit can output 3000 psi, and the computer 208 can define the threshold pressure value measured by the pressure transducer 222 as 3000 psi. The pressure transducer 222 may measure the output pressure from the pressure-compensated pump 204 as 2998 psi, which can cause the computer 208 to toggle the directional control valve 210 to configure the load sense pump 202 in a pressure-compensated configuration. A moment later before the load sense pump 202 may even provide hydraulic fluid to the pressure-compensated load 236, the pressure transducer 222 may read a pressure value of 3003 psi. This can cause the computer 208 to toggle the directional control valve 210 to configure the load sense pump 202 back to a load sense configuration. Including instructions in the computer 208 to maintain the most recent configuration of load sense pump 202 for a set period before switching configurations can prevent unnecessary energy-wasting switching and reduce depreciation of system component durability.

In some examples, the computer 208 can include instructions to anticipate failure of the pressure-compensated pump 204 based on a recognizable pattern, such as the curvature of a pressure output drop. The computer 208 can prepare to toggle the directional control valve 210 at a certain point in detecting an imminent failure of the pressure-compensated pump 204. This can allow the load sense pump 202 to supply pressure to the pressure-compensated load 236 without the pressure-compensated load 236 losing hydraulic pressure. For example, the load sense pump 202 can be toggled at the proper time so the pressure-compensated load 236 is not subject to a pressure drop when the pressure-compensated pump 204 fails.

Load sense pumps can typically operate using less pressure and less energy as compared to pressure-compensated pumps within the same environment or in similar applications. In the example of FIG. 2, the load sense pump 202 and pressure-compensated pump 204 can be connected as a single circuit. If the load sense pump 202 and pressure-compensated pump 204 are in direct fluid communication, higher pressure levels provided by the pressure-compensated pump 204 can overpower the lower pressure levels provided by the load sense pump 202. Without a mechanism in place to prevent hydraulic fluid communication directly between the output lines of the load sense pump 202 and the pressure-compensated pump 204, the pressure-compensated pump 204 can cause unwanted feedback into the load sense pump 202 causing the load sense pump 202 to spin backwards.

In this example, a check valve 218 and a check valve 220 can be used to prevent one pump from overpowering the pressure levels of the other pump and further prevent hydraulic fluid from being fed back into a lower-pressure pump. The check valve 218 and the check valve 220 can ensure that the load sense pump 202 and the pressure-compensated pump 204 can operate their respective circuits individually during a load sense configuration without interference from the other pump. The check valve 218 and the check valve 220 can further ensure the load sense pump 202 can operate both circuits to provide hydraulic pressure to the load sense load 234 and pressure-compensated load 236 in the event of a pressure-compensated pump 204 failure.

The check valve 218 can prevent the pressure-compensated pump 204 from communicating hydraulic fluid to any pump circuit components fluidly connected to the load sense pump-line 228 (e.g., the load sense pump 202, load sense valve 212, load sense load 234) while the pressure-compensated pump 204 is operating properly. For example, when the pressure-compensated pump 204 is providing adequate pressure to the pressure-compensated load 236, the pressure-compensated pump-line 232 can contain a higher pressure than the load sense pump-line 228. This pressure differential across the check valve 218 can keep the check valve 218 closed, blocking the pressure on the pressure-compensated pump-line 232 from leaking into the load sense circuit and overpowering the load sense pump 202.

The check valve 218 can allow hydraulic fluid to be communicated from the load sense pump-line 228 to the pressure-compensated load 236 when the pressure-compensated pump-line 232 contains a lower pressure than the load sense pump-line 228. This pressure differential across the check valve 218 can open the valve, allowing the load sense pump 202 in a pressure-compensated configuration to supply hydraulic pressure to the pressure-compensated load 236.

The check valve 220 can be used to prevent the load sense pump 202 from communicating hydraulic fluid into the pressure-compensated pump 204 when the pressure-compensated pump 204 is not pressure-compensated providing adequate pressure to the pressure-compensated load 236. During a pressure-compensated pump 204 failure, the pressure of hydraulic fluid contained in the pressure-compensated pump-line 232 supplied by the load sense pump 202 can be higher than the pressure between the pressure-compensated pump 204 and the check valve 220. This pressure differential across the check valve 220 can keep the check valve 220 closed, blocking the pressure on the pressure-compensated pump-line 232 from leaking up into and overpowering the pressure-compensated pump 204. When the pressure-compensated pump 204 is supplying adequate pressure, the pressure of hydraulic fluid contained in the pressure-compensated pump-line 232 supplied by the load sense pump 202 can be lower than the pressure between the pressure-compensated pump 204 and the check valve 220. This pressure differential across the check valve 220 can open the valve, allowing the pressure-compensated pump 204 to supply hydraulic pressure to the pressure-compensated load 236.

In some examples, the pressure transducer 222 can be communicatively coupled to the output of the pressure-compensated pump 204 before the check valve 220. Positioning the pressure transducer 222 before the check valve 220 can ensure that the pressure transducer 222 reads only pressure values related to the pressure-compensated pump 204. This can allow the computer 208 to make decisions with respect to the load sense pump 202 configuration based on the operating status of the pressure-compensated pump 204.

In some examples, the directional control valve 210 can include a manual override. In the case of an electrical system failure, an operator can override the directional control valve 210 to configure the load sense pump 202 into a pressure-compensated configuration or lead sense configuration. The override can be implemented by a mechanism that can be interacted with by an operator, to control the setting of the directional control valve 210. For example, if the communication medium 224 to the directional control valve 210 from the computer 208 is disconnected or the computer 208 is nonfunctional, an operator can manually shift the directional control valve 210 to adjust the load sense pump 202 configuration as needed. In other examples, the computer 208 can issue commands to toggle the directional control valve 210 despite the pressure measured by the pressure transducer 222. For example, an operator can instruct the computer 208 to issue a command preventing the load sense pump 202 from being used as a pressure-compensated pump backup for diagnostic purposes).

Figure 3:
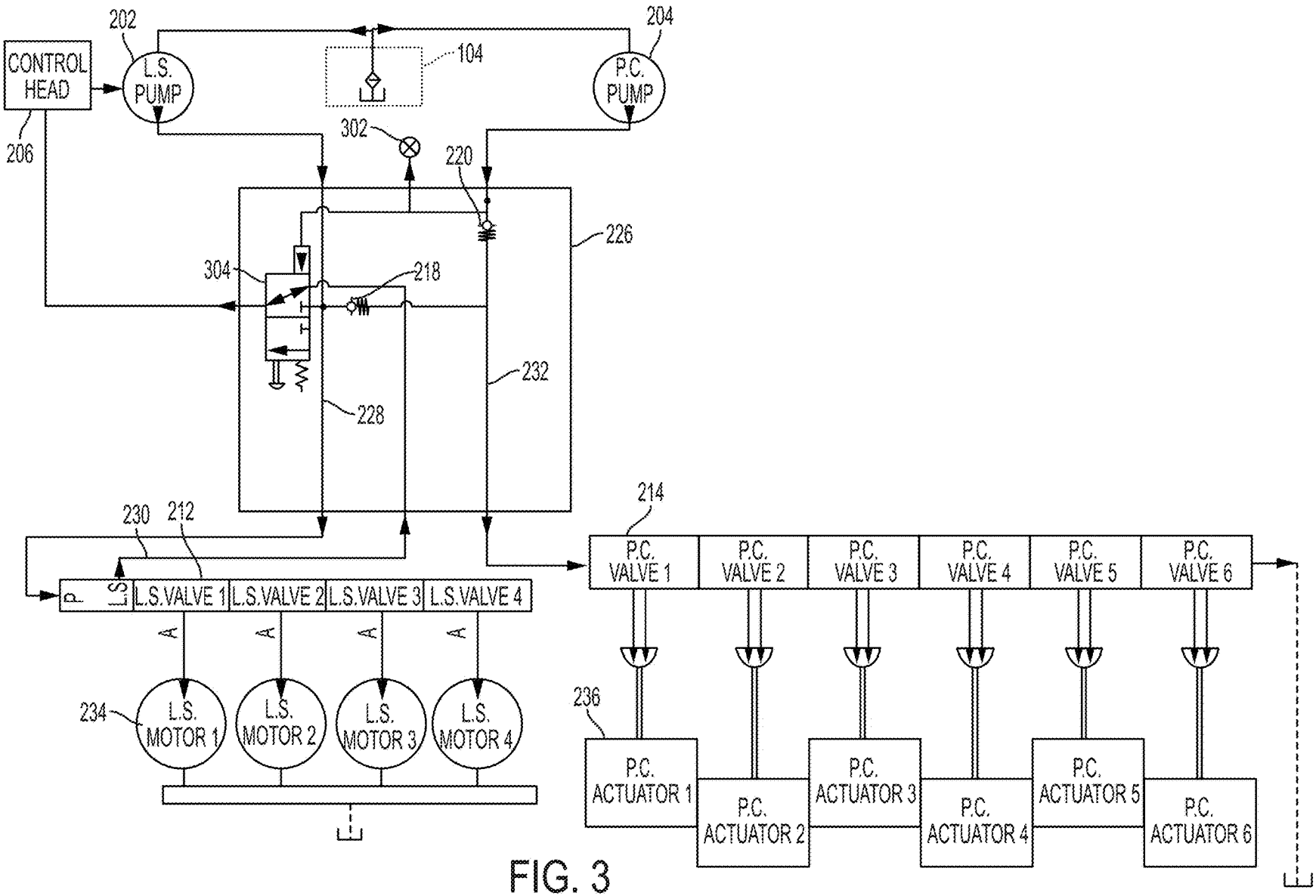
FIG. 3 is a schematic of a system for using a load sense pump as a backup for a pressure-compensated pump with mechanical switching according to one aspect of the disclosure.

FIG. 3 is a schematic of a system for using a load sense pump as a backup for a pressure-compensated pump with mechanical switching according to one example. As compared to the directional control valve 210 depicted in FIG. 2, which may be an electrically operated switch, some embodiments can implement a directional control valve controlled by mechanical means. In this example, a directional control valve 304 can be used to toggle the load sense pump 202 between the pressure-compensated configuration and the load sense configuration.

The directional control valve 304 can be a pilot operated valve that can use the pilot pressure of the pressure-compensated pump 204 to toggle the directional control valve 304. A pilot pressure line 302 can be connected to the directional control valve 304. The pilot pressure line 302 can source pilot pressure from the pressure-compensated pump 204. A fully operational pressure-compensated pump 204 can supply pilot pressure to the directional control valve 304 to configure the load sense pump 202 in a load sense configuration. In a load sense configuration, the directional control valve 304 can connect the control head 206 to the load-sense feedback line 230.

Loss of pilot pressure applied to the directional control valve 304 in the event of a pressure-compensated pump 204 failure can switch the directional control valve 304. In response to the loss of pilot pressure, the directional control valve 304 can connect the output of the load sense pump 202 to the control head 206 to configure the load sense pump 202 in a pressure-compensated configuration. In some examples, the directional control valve 304 can be spring-operated that can toggle the active connection to the control head 206 in response to the pilot pressure present in the pilot pressure line 302.

Configuring the load sense pump into a load sense configuration or pressure-compensated configuration using mechanical means can provide for a more robust and reliable backup pump system design. A computer may no longer toggle the directional control valve 304, which can reduce the risk of system failure due to issues with electrical components. A system using mechanical switching techniques may also reduce overall cost of the system by reducing the number of required components. For example, a pressure transducer and a computer may no longer be needed to configure the load sense pump 202 as a backup for the pressure-compensated pump 204.

The directional control valve 304 can include an override feature implemented similarly to the directional control valve 210. An override can be beneficial in instances where pressure from the pressure-compensated pump 204 may be fluctuating or low enough to cause the pilot operation to flutter or alternate.

Figure 4:
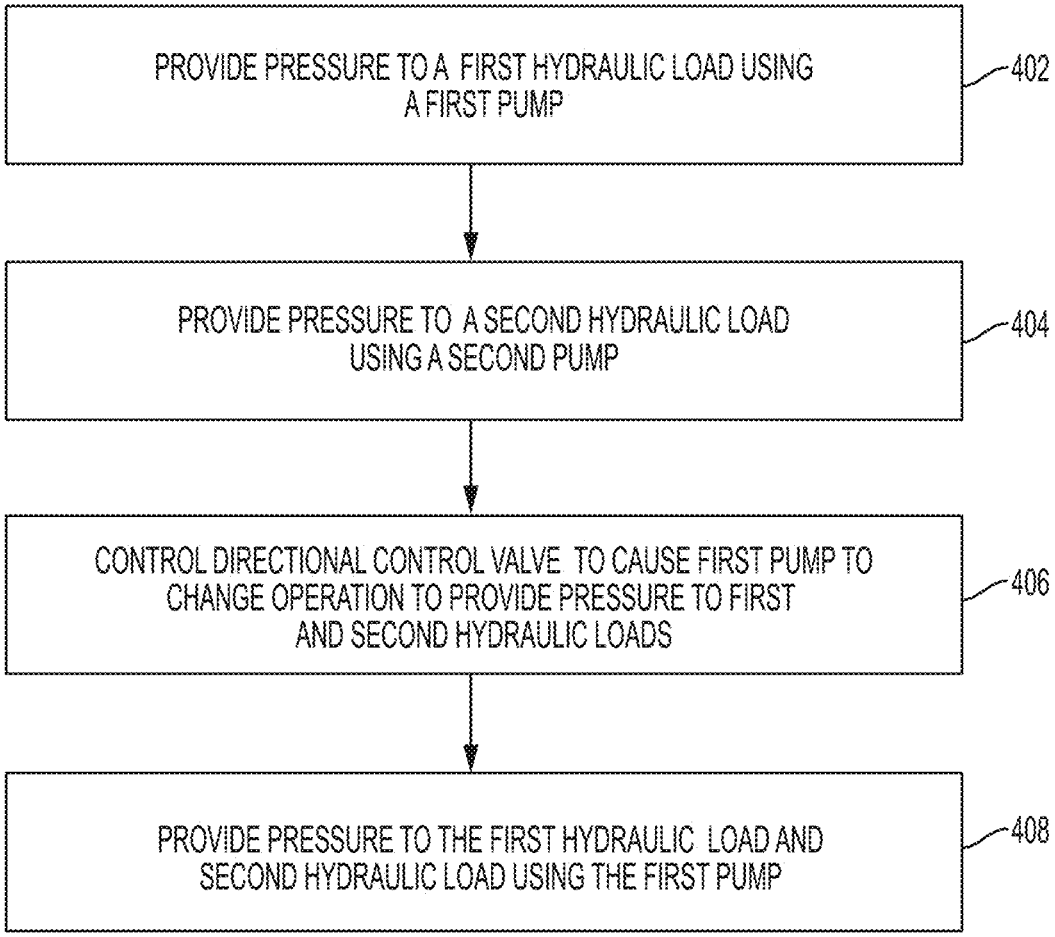
FIG. 4 is an example of a flow chart of a process for using a load sense pump as a backup for a pressure-compensated pump according to one aspect of the disclosure.

FIG. 4 is an example of a flow chart of a process for using a load sense pump as a backup for a pressure-compensated pump according to one example.

In block 402, a first pump provides pressure to a first hydraulic load. The first pump can be a load sense pump that provides pressure to a load sense load as described by the previous examples. The first pump can provide pressure to the first hydraulic load for operating the first hydraulic load. In some examples, the first pump can be connected to multiple hydraulic loads. The first pump can provide sufficient total pressure to operate each of the connected hydraulic loads.

In block 404, a second pump provides pressure to a second hydraulic load. The second pump can be a pressure-compensated pump that provides pressure to a pressure-compensated load as described by the previous examples. The second pump can provide pressure to the second hydraulic load for operating the second hydraulic load. In some examples, the second pump can be connected to multiple hydraulic loads. The second pump can provide sufficient total pressure to operate each of the connected hydraulic loads.

In some examples, the processes at blocks 402 and 404 can be performed in any order with respect to each other, and may be performed simultaneously such that the first pump can provide pressure to the first hydraulic load at the same time that the second pump provides pressure to the second hydraulic load. Blocks 402 and 404 describe the first pump and the second pump operating independent of each other on separate circuits prior to the process described by block 406.

In block 406, a directional control valve is controlled to cause the first pump to change operation to provide pressure to the first hydraulic load and through a check valve to the second hydraulic load. Changing operation of the first pump can include any of the previously discussed examples relating to changing the load sense pump (e.g., first pump) into a pressure-compensated configuration from a load sense configuration. Controlling the directional control valve to change operation of the first pump can be performed in response to a failure of the second pump. Various techniques may be used to control the directional control valve, such as electrical signals provided by a computing device, or pilot pressure from the pressure-compensated pump (e.g., second pump) to drive a spring-operated version of the directional control valve.

Controlling the directional control valve can include switching the input to the directional control valve. For example, at block 402, the directional control valve can be connected to a feedback sense line at the first hydraulic load. The directional control valve can relay the pressure level at the first hydraulic load to a control head, which can determine a pressure differential. Depending on the pressure differential, the control head can direct the first pump to raise, lower, or remain at the pressure level provided by the first pump to the first hydraulic pump.

In block 406, controlling the directional control valve to cause the first pump to change operation can include switching the directional control valve input to the output of the first pump, as opposed to the feedback sense line at the first hydraulic load. As previously described, this can cause the first pump to increase the pressure output continuously to be able to provide enough pressure for the first hydraulic load and the second hydraulic load to operate. The first pump can provide pressure to the second hydraulic load through a check valve. The check valve can be used to prevent the flow of hydraulic fluid from the second pump to the first pump, but can allow communication of hydraulic fluid from the first pump to the second hydraulic load according to the previously described embodiments.

In block 408, the first pump provides pressure to the first hydraulic load and through the check valve to the second hydraulic load. After the directional control valve is controlled to allow the first pump to change operation as described in block 406, the first pump can increase the pressure output to reach a maximum pressure set point. The first pump can provide adequate pressure to the first hydraulic load and the second hydraulic load in the event of a failure of the second pump.

In some examples, the second pump can become operational again while the first pump is providing pressure to the first hydraulic load and the second hydraulic load. Once the second pump can provide a sufficient pressure to operate the second hydraulic load independent of the first pump, the directional valve can be controlled to change the operation of the first pump back to have the first pump provide pressure only to the first hydraulic load and not the second hydraulic load.

Figure 5:
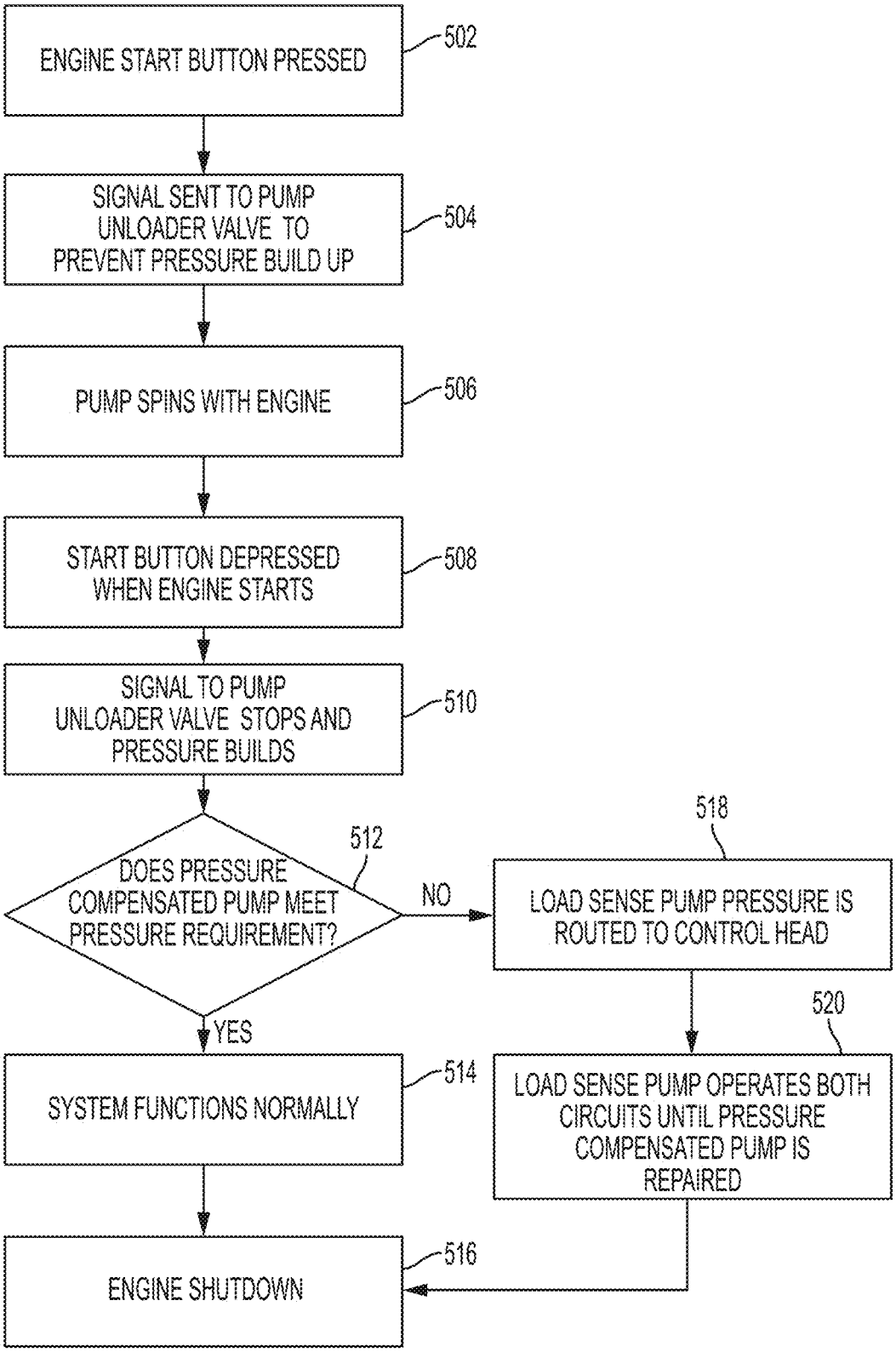
FIG. 5 is an example of a flow chart of a process for using a load sense pump as a backup for a pressure-compensated pump in a fracturing blender environment according to one aspect of the disclosure.

FIG. 5 is an example of a flow chart of a process for using a load sense pump as a backup for a pressure-compensated pump in a fracturing blender environment according to one example.

In block 502, an engine start button is pressed. The engine start button can be used to begin to power on the engine. In some examples, the engine can be any other type of motor or prime mover used to power various system components including hydraulic pumps. The engine can be located on a fracturing blender truck or a similar assembly used for fracturing in a fracturing blender environment. In some examples, multiple engines may exist to power separate pumping circuits and corresponding components. A single engine start button can be used to initiate the multiple engines at once, or each engine may have separate start buttons to initiate each engine independently.

In block 504, a signal is sent to a pump unloader valve to prevent pressure build up. The signal can be sent to the pump unloader valve by a computing device that is communicatively coupled to the pump unloader valve. A pump unloader valve can be an optional component of a pump or a separate component installed externally to a pump to prevent excessive amounts of power from being drawn in a single instance. Preventing the load sense pump and the pressure-compensated pump from generating pressure at the same time upon engine startup may be necessary to prevent the engine starter from being overloaded. Upon startup, the pressure-compensated pump can attempt to generate a maximum pressure output as soon as the pressure-compensated pump begins to spin unless the pressure-compensated pump is controlled to do otherwise. A pump unloader valve can be used while powering up the load sense pump, pressure-compensated pump, and engine so that additional energy required to build up pressure within the load sense pump and pressure-compensated pump is not drawn. This can reduce the burden on the engine at startup and prevent unnecessary degradation to the engine.

In some examples using a load sense pump configurable as a backup for a pressure-compensated pump, a pump unloader valve may only be required for the pressure-compensated pump and not the load sense pump. In those examples, the load sense pump may not be able to determine the output pressure of the load sense pump until the directional control valve is controlled to relay the output of the load sense pump to the control head when the load sense pump switches to a pressure-compensated configuration. Because the load sense pump may not be able to determine the output pressure provided by the load sense pump upon engine startup, the load sense pump may not generate increasing pressure values in an attempt to reach the maximum set point. Thus, a pump unloader valve may not be needed for the load sense pump because the load sense pump may not be drawing exorbitant amounts of energy and may not overload the engine starter. In other examples implementing a spring-operated directional control valve or other type of mechanically initiated control valve, the load sense pump may require a pump unloader valve to prevent the load sense pump from drawing too much energy from the engine starter upon engine startup.

In block 506, the pump spins up simultaneously with the engine. Allowing the pressure-compensated pump to spin up with the engine while preventing the pressure-compensated pump from building up pressure can reduce the power required from engine starter.

In block 508, the start button is depressed when the engine starts. When the engine has been fully engaged after being initiated in block 502, the start button can become depressed to represent that the engine is functioning.

In block 510, the signal sent to the pump unloader valve in block 504 is stopped and the pressure-compensated pump can begin to build pressure. Once the engine is safely turned on, there may no longer be a concern to overload the engine starter when drawing additional energy during pressurization of the pumps. The pressure-compensated pump can safely begin to provide pressure to the loads and reach the maximum set point without overloading the engine starter because the engine starter is no longer being used.

In block 512, the output of the pressure-compensated pump is measured to determine if the pressure-compensated pump is providing adequate pressure to the connected loads. A computing device can be used to determine if the output of pressure-compensated pump is at a certain threshold level to operate the loads. This process can be performed at any time after the engine and pressure-compensated pump are turned on. For example, the computing device can constantly monitor the output of the pressure-compensated pump to determine if remedial action is required.

In block 514, the output of the pressure-compensated pump is determined to be adequate for operating the connected loads, and the system continues to operate with no change. When the pressure-compensated pump is functioning properly, the load sense pump can be in a load sense configuration operating independent of the pressure-compensated pump.

In block 518, the output of the pressure-compensated pump is determined to be inadequate for operating the connected loads, and the output of the load sense pump is routed to the control head. Routing the output of the load sense pump to the control head by a directional control valve can cause the load sense pump to be configured as a pressure-compensated pump backup as described by the previous examples. The directional control valve can route the pressure of the load sense pump to the control head at the instruction of a computing device or by spring-operated actuation.

In block 520, the load sense pump provides pressure to the loads on the load sense circuit and the loads on the pressure-compensated circuit until the pressure-compensated circuit is repaired. The pressure-compensated circuit can be repaired or restarted while the load sense pump is in a pressure-compensated backup configuration. If the pressure-compensated pump is successfully repaired or restarted to produce adequate pressure for the pressure-compensated loads, the processes described by block 512 are performed to determine when the load sense pump may be reconfigured in a load sense configuration.

In block 516, the engine is shut down. The engine can be shut down during processes described by block 514 such that the load sense pump and pressure-compensated pump power down. The engine can be shut down during processes described by block 520 such that the load sense pump is powered down and the pressure-compensated pump is powered down if not already shut off. In some examples, engine shut down can be used as a remedial measure in case of system failure or lockup, and the engine may be restarted according to the process described by block 502.

In some aspects, systems, devices, and methods using a load sense pump as a backup for a pressure-compensated pump are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a pumping system comprising: a first pump to provide pressure to a first hydraulic load; a second pump to provide pressure to a second hydraulic load; a check valve; and a directional control valve that is controllable to cause the first pump to change operation to provide pressure to the first hydraulic load and, through the check valve, to the second hydraulic load.

Example 2 is the pumping system of example 1, wherein the directional control valve is an electrically operated valve, the directional control valve being configurable to receive an electrical signal to cause the first pump to change operation in response to receiving the electrical signal.

Example 3 is the pumping system of example 1, further comprising: a computing device; and a non-transitory computer-readable medium that includes instructions that are executable by the computing device to: determine an output pressure level of the second pump, the output pressure level being measureable by a pressure transducer, the pressure transducer being communicatively couplable to the computing device; and transmit an electrical signal to the directional control valve to cause the first pump to change operation in response to the output pressure level of the second pump.

Example 4 is the pumping system of example 1, further comprising a control head communicatively couplable to the first pump and the directional control valve, the control head being useable to determine a pressure differential between an output pressure level of the first pump and an input to the directional control valve, wherein the directional control valve is controllable to use the output pressure level of the first pump as the input, and wherein the first pump is capable of increasing pressure provided to the first hydraulic load and the second hydraulic load in response to the pressure differential.

Example 5 is the pumping system of example 1, wherein the directional control valve is controllable to cause the first pump to change operation using an override setting operatable by a user.

Example 6 is the pumping system of example 1, further comprising a second check valve useable to prevent the first pump from providing pressure to the second pump, and wherein the check valve is useable to prevent the second pump from providing pressure to the first pump, the directional control valve, and the first hydraulic load.

Example 7 is the pumping system of example 1, wherein the first pump is a load sense pump that is usable as a backup for a pressure-compensated pump and the second pump is the pressure-compensated pump.

Example 8 is a flow distribution manifold comprising: a check valve; and a directional control valve that is controllable to cause a first pump to change operation to provide pressure to a first hydraulic load and through the check valve to a second hydraulic load, wherein the first pump is configured to provide pressure to the first hydraulic load prior to the operation change and a second pump is configured to provide pressure to the second hydraulic load prior to the operation change.

Example 9 is the flow distribution manifold of example 8, wherein the directional control valve is an electrically operated valve, the directional control valve being configurable to receive an electrical signal to cause the first pump to change operation in response to receiving the electrical signal.

Example 10 is the flow distribution manifold of example 8, wherein the directional control valve is communicatively couplable to a computing device, the computing device being communicatively couplable to a non-transitory computer-readable medium that includes instructions that are executable by the computing device to: determine an output pressure level of the second pump, the output pressure level being measureable by a pressure transducer, the pressure transducer being communicatively couplable to the computing device; and transmit an electrical signal to the directional control valve to cause the first pump to change operation in response to the output pressure level of the second pump.

Example 11 is the flow distribution manifold of example 8, wherein the directional control valve is communicatively couplable to a control head that is communicatively couplable to the first pump, the control head being useable to determine a pressure differential between an output pressure level of the first pump and an input to the directional control valve, wherein the directional control valve is controllable to use the output pressure level of the first pump as the input, and wherein the first pump is capable of increasing pressure provided to the first hydraulic load and the second hydraulic load in response to the pressure differential.

Example 12 is the flow distribution manifold of example 8, wherein the directional control valve is controllable to cause the first pump to change operation using an override setting operatable by a user.

Example 13 is the flow distribution manifold of example 8, further comprising a second check valve useable to prevent the first pump from providing pressure to the second pump, and wherein the check valve is useable to prevent the second pump from providing pressure to the first pump, the directional control valve, and the first hydraulic load.

Example 14 is the flow distribution manifold of example 8, wherein the first pump is a load sense pump that is usable as a backup for a pressure-compensated pump and the second pump is the pressure-compensated pump.

Example 15 is a method comprising: providing, by a first pump, pressure to a first hydraulic load; providing, by a second pump, pressure to a second hydraulic load; controlling a directional control valve to cause the first pump to change operation to provide pressure to the first hydraulic load and, through a check valve, to the second hydraulic load; and providing, by the first pump, pressure to the first hydraulic load and through the check valve to the second hydraulic load.

Example 16 is the method of example 15, further comprising: receiving, by the directional control valve, an electrical signal, the directional control valve being an electrically operated valve; controlling the directional control valve to change operation of the first pump in response to receiving the electrical signal; and using the first pump as a backup for a pressure-compensated pump in response to the directional control valve changing operation of the first pump, wherein the first pump is a load sense pump and the second pump is the pressure-compensated pump.

Example 17 is the method of example 15, further comprising: measuring, by a pressure transducer, an output pressure level of the second pump; receiving, by a computing device, the output pressure level of the second pump from the pressure transducer; and transmitting, by the computing device, an electrical signal to the directional control valve to cause the first pump to change operation in response to the output pressure level of the second pump.

Example 18 is the method of example 15, further comprising: determining, by a control head, a pressure differential between an output pressure level of the first pump and an input to the directional control valve, the control head being communicatively coupled to the first pump and the directional control valve; using the output pressure level of the first pump as the input to the directional control valve; and increasing pressure from the first pump provided to the first hydraulic load and the second hydraulic load in response to the pressure differential.

Example 19 is the method of example 15, further comprising controlling, by an override setting, the directional control valve to cause the first pump to change operation, the override setting being operated by a user.

Example 20 is the method of example 15, further comprising: preventing, by the check valve, the second pump from providing pressure to the first pump, the directional control valve, and the first hydraulic load; and preventing, by a second check valve, the first pump from providing pressure to the second pump.

Example 21 is a flow distribution manifold comprising: a check valve; and a directional control valve that is controllable to cause a first pump to change operation to provide pressure to a first hydraulic load and through the check valve to a second hydraulic load, wherein the first pump is configured to provide pressure to the first hydraulic load prior to the operation change and a second pump is configured to provide pressure to the second hydraulic load prior to the operation change.

Example 22 is the flow distribution manifold of example 21, wherein the directional control valve is an electrically operated valve, the directional control valve being configurable to receive an electrical signal to cause the first pump to change operation in response to receiving the electrical signal.

Example 23 is the flow distribution manifold of any of examples 21 to 22, wherein the directional control valve is communicatively couplable to a computing device, the computing device being communicatively couplable to a non-transitory computer-readable medium that includes instructions that are executable by the computing device to: determine an output pressure level of the second pump, the output pressure level being measureable by a pressure transducer, the pressure transducer being communicatively couplable to the computing device; and transmit an electrical signal to the directional control valve to cause the first pump to change operation in response to the output pressure level of the second pump.

Example 24 is the flow distribution manifold of any of examples 21 to 23, wherein the directional control valve is communicatively couplable to a control head that is communicatively couplable to the first pump, the control head being useable to determine a pressure differential between an output pressure level of the first pump and an input to the directional control valve, wherein the directional control valve is controllable to use the output pressure level of the first pump as the input, and wherein the first pump is capable of increasing pressure provided to the first hydraulic load and the second hydraulic load in response to the pressure differential.

Example 25 is the flow distribution manifold of any of examples 21 to 24, wherein the directional control valve is controllable to cause the first pump to change operation using an override setting operatable by a user.

Example 26 is the flow distribution manifold of any of examples 21 to 25, further comprising a second check valve useable to prevent the first pump from providing pressure to the second pump, and wherein the check valve is useable to prevent the second pump from providing pressure to the first pump, the directional control valve, and the first hydraulic load.

Example 27 is the flow distribution manifold of any of examples 21 to 26, wherein the first pump is a load sense pump that is usable as a backup for a pressure-compensated pump and the second pump is the pressure-compensated pump.

Example 28 is the flow distribution manifold of any of examples 21 to 27, wherein the flow distribution manifold is in a pumping system that comprises: the first pump to provide pressure to the first hydraulic load; and the second pump to provide pressure to the second hydraulic load.

Example 29 is a method comprising: providing, by a first pump, pressure to a first hydraulic load; providing, by a second pump, pressure to a second hydraulic load; controlling a directional control valve to cause the first pump to change operation to provide pressure to the first hydraulic load and, through a check valve, to the second hydraulic load; and providing, by the first pump, pressure to the first hydraulic load and through the check valve to the second hydraulic load.

Example 30 is the method of example 29, further comprising: receiving, by the directional control valve, an electrical signal, the directional control valve being an electrically operated valve; controlling the directional control valve to change operation of the first pump in response to receiving the electrical signal; and using the first pump as a backup for a pressure-compensated pump in response to the directional control valve changing operation of the first pump, wherein the first pump is a load sense pump and the second pump is the pressure-compensated pump.

Example 31 is the method of any of examples 29 to 30, further comprising: measuring, by a pressure transducer, an output pressure level of the second pump; receiving, by a computing device, the output pressure level of the second pump from the pressure transducer; and transmitting, by the computing device, an electrical signal to the directional control valve to cause the first pump to change operation in response to the output pressure level of the second pump.

Example 32 is the method of any of examples 29 to 31, further comprising: determining, by a control head, a pressure differential between an output pressure level of the first pump and an input to the directional control valve, the control head being communicatively coupled to the first pump and the directional control valve; using the output pressure level of the first pump as the input to the directional control valve; and increasing pressure from the first pump provided to the first hydraulic load and the second hydraulic load in response to the pressure differential.

Example 33 is the method of any of examples 29 to 32, further comprising controlling, by an override setting, the directional control valve to cause the first pump to change operation, the override setting being operated by a user.

Example 34 is the method of any of examples 29 to 33, further comprising: preventing, by the check valve, the second pump from providing pressure to the first pump, the directional control valve, and the first hydraulic load.

Example 35 is the method of any of examples 29 to 34, further comprising: preventing, by a second check valve, the first pump from providing pressure to the second pump.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A pumping system comprising:

a first pump to provide pressure to a first hydraulic load;

a second pump to provide pressure to a second hydraulic load;

a check valve;

a directional control valve that is controllable to cause the first pump to change operation to provide pressure to the first hydraulic load and, through the check valve, to the second hydraulic load;

a computing device; and a non-transitory computer-readable medium that includes instructions that are executable by the computing device to:

determine an output pressure level of the second pump, the output pressure level being measureable by a pressure transducer, the pressure transducer being communicatively couplable to the computing device; and transmit an electrical signal to the directional control valve to cause the first pump to change operation in response to the output pressure level of the second pump.

2. The pumping system of claim 1, wherein the directional control valve is an electrically operated valve, the directional control valve being configurable to receive an electrical signal to cause the first pump to change operation in response to receiving the electrical signal.

3. The pumping system of claim 1, further comprising a control head communicatively couplable to the first pump and the directional control valve, the control head being useable to determine a pressure differential between an output pressure level of the first pump and an input to the directional control valve, wherein the directional control valve is controllable to use the output pressure level of the first pump as the input, and wherein the first pump is capable of increasing pressure provided to the first hydraulic load and the second hydraulic load in response to the pressure differential.

4. The pumping system of claim 1, wherein the directional control valve is controllable to cause the first pump to change operation using an override setting operatable by a user.

5. The pumping system of claim 1, further comprising a second check valve useable to prevent the first pump from providing pressure to the second pump, and wherein the check valve is useable to prevent the second pump from providing pressure to the first pump, the directional control valve, and the first hydraulic load.

6. The pumping system of claim 1, wherein the first pump is a load sense pump that is usable as a backup for a pressure-compensated pump and the second pump is the pressure-compensated pump.

7. A flow distribution manifold comprising:

a check valve;

a directional control valve that is controllable to cause a first pump to change operation to provide pressure to a first hydraulic load and through the check valve to a second hydraulic load, wherein the first pump is configured to provide pressure to the first hydraulic load prior to the operation change and a second pump is configured to provide pressure to the second hydraulic load prior to the operation change, wherein the directional control valve is communicatively couplable to a computing device, the computing device being communicatively couplable to a non-transitory computer-readable medium that includes instructions that are executable by the computing device to:

determine an output pressure level of the second pump, the output pressure level being measureable by a pressure transducer, the pressure transducer being communicatively couplable to the computing device; and transmit an electrical signal to the directional control valve to cause the first pump to change operation in response to the output pressure level of the second pump.

8. The flow distribution manifold of claim 7, wherein the directional control valve is an electrically operated valve, the directional control valve being configurable to receive an electrical signal to cause the first pump to change operation in response to receiving the electrical signal.

9. The flow distribution manifold of claim 7, wherein the directional control valve is communicatively couplable to a control head that is communicatively couplable to the first pump, the control head being useable to determine a pressure differential between an output pressure level of the first pump and an input to the directional control valve, wherein the directional control valve is controllable to use the output pressure level of the first pump as the input, and wherein the first pump is capable of increasing pressure provided to the first hydraulic load and the second hydraulic load in response to the pressure differential.

10. The flow distribution manifold of claim 7, wherein the directional control valve is controllable to cause the first pump to change operation using an override setting operatable by a user.

11. The flow distribution manifold of claim 7, further comprising a second check valve useable to prevent the first pump from providing pressure to the second pump, and wherein the check valve is useable to prevent the second pump from providing pressure to the first pump, the directional control valve, and the first hydraulic load.

12. The flow distribution manifold of claim 7, wherein the first pump is a load sense pump that is usable as a backup for a pressure-compensated pump and the second pump is the pressure-compensated pump.

13. A method comprising:

providing, by a first pump, pressure to a first hydraulic load;

providing, by a second pump, pressure to a second hydraulic load;

controlling a directional control valve to cause the first pump to change operation to provide pressure to the first hydraulic load and, through a check valve, to the second hydraulic load;

providing, by the first pump, pressure to the first hydraulic load and through the check valve to the second hydraulic load;

measuring, by a pressure transducer, an output pressure level of the second pump;

receiving, by a computing device, the output pressure level of the second pump from the pressure transducer; and transmitting, by the computing device, an electrical signal to the directional control valve to cause the first pump to change operation in response to the output pressure level of the second pump.

14. The method of claim 13, further comprising:

receiving, by the directional control valve, an electrical signal, the directional control valve being an electrically operated valve;

controlling the directional control valve to change operation of the first pump in response to receiving the electrical signal; and using the first pump as a backup for a pressure-compensated pump in response to the directional control valve changing operation of the first pump, wherein the first pump is a load sense pump and the second pump is the pressure-compensated pump.

15. The method of claim 13, further comprising:

determining, by a control head, a pressure differential between an output pressure level of the first pump and an input to the directional control valve, the control head being communicatively coupled to the first pump and the directional control valve;

using the output pressure level of the first pump as the input to the directional control valve; and increasing pressure from the first pump provided to the first hydraulic load and the second hydraulic load in response to the pressure differential.

16. The method of claim 13, further comprising controlling, by an override setting, the directional control valve to cause the first pump to change operation, the override setting being operated by a user.

17. The method of claim 13, further comprising:

preventing, by the check valve, the second pump from providing pressure to the first pump, the directional control valve, and the first hydraulic load; and preventing, by a second check valve, the first pump from providing pressure to the second pump.

* * * * *